US010749291B2

(12) United States Patent
Schmidt

(10) Patent No.: US 10,749,291 B2
(45) Date of Patent: Aug. 18, 2020

(54) ELECTRICAL CONNECTING CABLE

(71) Applicant: Aptiv Technologies Limited, St. Michael (BB)

(72) Inventor: Rainer Schmidt, Nuremberg (DE)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 16/203,717

(22) Filed: Nov. 29, 2018

(65) Prior Publication Data

US 2019/0181583 A1 Jun. 13, 2019

(30) Foreign Application Priority Data

Dec. 7, 2017 (EP) ..... 17205935

(51) Int. Cl.

| | |
|---|---|
| ***H01R 13/52*** | (2006.01) |
| ***H01R 13/506*** | (2006.01) |
| ***H01R 13/58*** | (2006.01) |
| ***H01R 13/59*** | (2006.01) |
| ***H01R 13/631*** | (2006.01) |
| ***H01R 43/20*** | (2006.01) |

(52) U.S. Cl.

CPC ..... *H01R 13/5205* (2013.01); *H01R 13/506* (2013.01); *H01R 13/5825* (2013.01); *H01R 13/59* (2013.01); *H01R 13/631* (2013.01); *H01R 43/20* (2013.01)

(58) Field of Classification Search

None

See application file for complete search history.

(56) References Cited

U.S. PATENT DOCUMENTS 3,010,747 A * 11/1961 Bondon ..... F16B 7/025 403/281
4,030,741 A * 6/1977 Fidrych ..... F16L 5/00 285/149.1
4,549,755 A * 10/1985 Kot ..... H02G 3/0658 174/51
4,640,568 A * 2/1987 Magourou ..... H01R 13/59 439/460
4,810,832 A * 3/1989 Spinner ..... H01R 13/5205 174/654
5,059,747 A * 10/1991 Bawa ..... H02G 3/0675 174/541

(Continued)

FOREIGN PATENT DOCUMENTS

EP 3249757 A1 11/2017

*Primary Examiner* — Oscar C Jimenez

(74) *Attorney, Agent, or Firm* — Billion & Amitage; Robert Myers

(57) ABSTRACT

An electrical connecting cable includes a plug housing, an electrical lead, a ring element, an elastic sealing element and a cap. The plug housing has a tubular lead-in region for guiding the electrical lead into the plug housing. The lead-in region is directed along a longitudinal axis of the electrical lead and has a constriction. The cap is fastened on the plug housing by retaining means. The cap has an opening for passing through the electrical lead. The ring element surrounds the electrical lead at least in part and the sealing element surrounds the electrical lead. The ring element and the sealing element are arranged between the constriction and the cap. A method of manufacturing the electrical connecting cable is also presented.

13 Claims, 9 Drawing Sheets

(56) References Cited

U.S. PATENT DOCUMENTS

| | | | | |
|---|---|---|---|---|
| 5,567,174 | A * | 10/1996 | Ericson, Jr. | H01R 13/5205 439/462 |
| 5,824,962 | A * | 10/1998 | Katsuma | H01R 13/5205 174/135 |
| 5,951,327 | A * | 9/1999 | Marik | H01R 9/0527 439/607.44 |
| 6,913,486 | B2 * | 7/2005 | Nagayasu | H01R 13/5208 439/587 |
| 2003/0135999 | A1 * | 7/2003 | Khemakhem | H01R 9/032 29/857 |
| 2011/0130035 | A1 | 6/2011 | Ebihara | |
| 2012/0159740 | A1 * | 6/2012 | Strelow | H02G 3/0658 16/2.2 |
| 2013/0029541 | A1 * | 1/2013 | Chiarelli | H01R 13/5205 439/781 |
| 2013/0330952 | A1 * | 12/2013 | Mori | H01R 13/426 439/271 |
| 2014/0273540 | A1 | 9/2014 | Brown | |
| 2019/0013626 | A1 * | 1/2019 | Grimm | H01R 9/032 |

* cited by examiner

ELECTRICAL CONNECTING CABLE

CROSS-REFERENCE TO RELATED APPLICATION

This application claims the benefit under 35 U.S.C. § 119(a) of patent application Ser. No. 17/205,935.4 filed in the European Patent Office on Dec. 7, 2017, the entire disclosure of which is hereby incorporated by reference.

TECHNICAL FIELD OF THE INVENTION

The invention relates to an electrical connecting cable for producing an electrical connection between two electrical devices, more particularly for connecting electrical devices in vehicles, as well as to a method for producing an electrical connecting cable.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
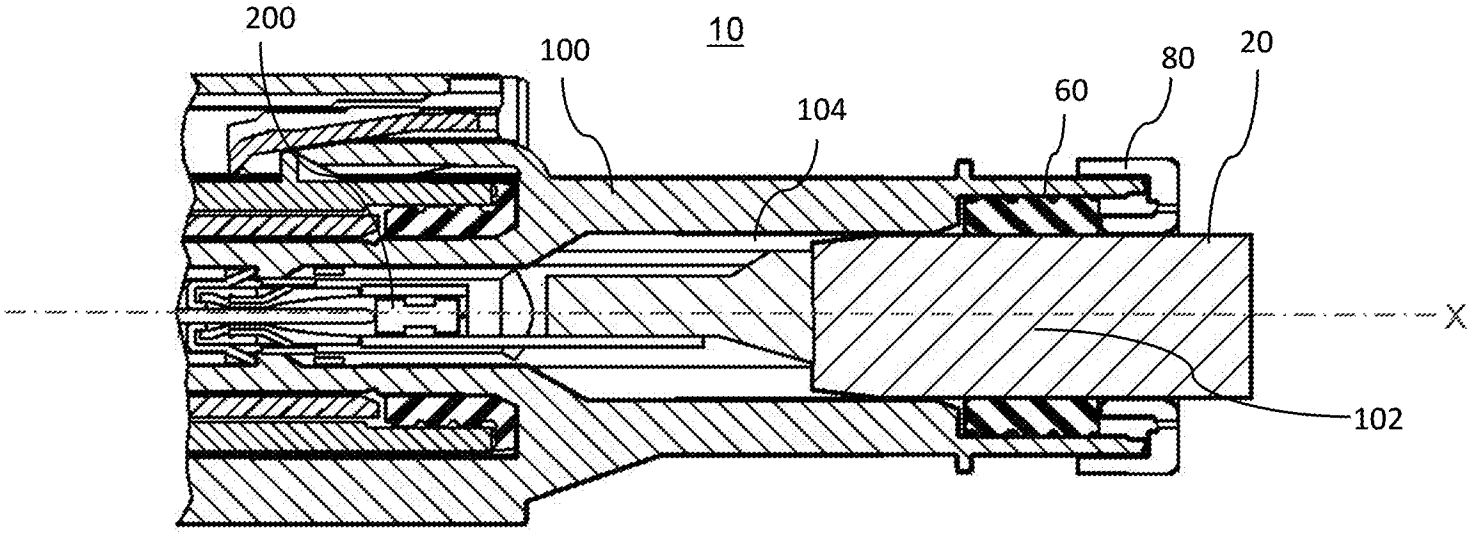
Fig. 1 prior art
FIG. 1 shows an cross-section view on an electrical connecting cable according to the prior art.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

An electrical connecting cable includes a plug housing, an electric cable, a ring element, an elastic sealing element and a cap. The plug housing has a tubular lead-in region for introducing the electric cable into the plug housing. The lead-in region is aligned along a longitudinal axis of the electric cable and has a constriction. The cap is fastened on the plug housing by retaining means. The cap has an opening for passing through the electrical lead. The ring element surrounds the electrical lead at least in part and the sealing element surrounds the electrical lead. The ring element and the sealing element are arranged between the constriction and the cap.

With the electrical connecting cable of the invention, the play which the electrical lead has inside the plug housing is eliminated through the ring element, at least in the region where the ring element contacts both the plug housing and the electrical lead. Vibrations which act on the electrical lead outside of the plug housing and likewise cause this to vibrate can be continued less severely from this region in the direction of the contact element. This structure prevents or reduces at least the vibrations of the contact element inside the plug housing caused by the electrical lead. Increased wear of the contact element is thereby avoided and the service life and reliability of the electrical connection is improved. The electrical connecting cable may be manufactured economically since it is to be produced with standard production equipment. The terms electrical lead and electric cable or cable used here all mean an electrical lead which is known from the prior art, in which these electrical leads have a conductive metal core (solid material or stranded) and a non-conductive insulation surrounding the core.

A method for manufacturing an electrical connecting cable comprises the steps:

- Providing a plug housing, an electrical lead, a ring element, an elastic sealing element, a cap and a contact element;
- Sliding one end of the electrical lead through the opening of the cap;
- Sliding the elastic sealing element onto the lead end of the electrical lead;
- Sliding the ring element onto the lead end of the electrical lead;
- Sliding the lead end through the tubular lead-in region of the plug housing;
- Attaching and electrically connecting the contact element onto the lead end of the electrical lead;
- Sliding in the lead so that the contact element is moved into the plug housing and latches therein;
- Sliding the cap in the direction of the plug housing until the retaining means have fixed the cap on the plug housing, wherein the ring element is pressed against a constriction in the plug housing and the electrical lead is thereby fixed in the plug housing.

The constriction preferably has at least one first guide face inclined in relation to the longitudinal axis and opposite the cap, and the ring element has a second guide face which is inclined at a second guide angle in relation to the longitudinal axis and is opposite the first guide face. The opposing guide faces form the contact surface between the plug housing and the ring element.

It is particularly preferred if the first guide face extends from an inner surface of the tubular lead-in region at a first guide angle to the longitudinal axis into the tubular lead-in region and then forms a funnel-shaped structure. The first guide face is inclined towards the contact element so that a force which acts on the ring element along the longitudinal axis in the direction of the contact element forces the ring element in the direction of the electrical lead. A force results from this which attempts to reduce the diameter of the ring element.

The first guiding angle and the second guiding angle preferably have the same value in relation to the longitudinal axis. If the two guide faces have the same angle in relation to the longitudinal axis then they lie flat against one another in the contact regions and can easily be displaced relative to one another.

It is particularly preferred if the first guiding angle and the second guiding angle have a value of 45° in relation to the longitudinal axis. A value of 45° enables a moderate reduction in the diameter of the ring element with a moderate amount of force.

The first guide face is preferably formed by a plurality of first part-faces, wherein the first part-faces are arranged on ribs which project into the tubular lead-in region. Dividing the first guide face up into first part-faces makes it possible to save material and weight in the plug housing, wherein the functional capacity remains.

The second guide face of the ring element is preferably pressed along the longitudinal axis by the elastic sealing element elastically against the first guide face of the constriction. The sealing element presses the ring element elastically in the direction of the contact element throughout the entire service life of the electrical connecting cable. Signs of ageing which can occur in the case of rigid structures are thereby avoided.

It is particularly preferred if the ring element consists of a ring-shaped body which has a separating point. A ring element where a separating point was inserted is substantially more flexible when it is radially deformed. The ring element can be radially deformed with little force and automatically returns to shape when the force is removed. The size of the change in diameter is substantially dependent on the size of the separating point. The separating point should in any case be selected so as to be small in relation to the overall periphery. In practice, the separating point should be no more than 10 percent of the overall periphery. The ring element can be made from metal or plastic, wherein the separating point can be introduced in the case of metal ring elements by sawing or milling. In the case of ring elements made from plastic, the separating point can be already provided in the injection moulding tool.

The separating point preferably runs diagonally to the axis of rotation of the ring-shaped body. Properties of the ring element can be positively changed through the position of the separating point or the arrangement of the cut through the ring element.

The ring element preferably has a base from which a plurality of fingers extend. The base adjoins the sealing element. The fingers are divided parallel to the longitudinal axis along the periphery of the ring element. The second guide face is formed by a plurality of second part-faces which are arranged at the finger ends. The fingers of the ring element are flexible so that they can be deformed. Each individual finger has a short distance from the adjoining finger. If all the fingers are deformed inwards they each move up to the adjoining finger and thereby form a smaller opening than in the unformed state. The electrical lead can be held without play in position in this smaller opening.

The ring element has, in a particularly preferred manner, a reduced diameter so long as the second guide face of the ring element is pressed along the longitudinal axis against the first guide face of the constriction. The ring element is pressed with its inner periphery against the outer periphery of the electrical lead, so long as the first guide face is pressed against the second guide face. A mechanical connection thereby remains between the electrical lead and the plug housing.

The elastic sealing element is preferably deformed elastically between the cap and the ring element. The elastic sealing element is deformed elastically between the cap and the ring element and thereby generates the required force to press the ring element in the direction of the contact element.

The retaining means for fastening the cap on the plug housing preferably comprise detent hooks which interact with protrusions on the plug housing in order to hold the cap on the plug housing. This structure has proved particularly sturdy and commercially viable in the prior art. However other fastening possibilities are also conceivable.

The electrical connecting cable is preferably designed for use in vehicles. Problems are known particularly in the case of vehicles with regard to vibrations. The inventive electrical connecting cable is particularly suitable for this use.

Preferred configurations of the invention will now be described in further detail. Similar or corresponding details of the object according to the invention are provided with the same reference numerals.

FIG. 1 shows an electrical connecting cable according to the prior art in a cross-section view. An electrical connecting cable 10 comprising a plug housing 100, an electrical lead 20, an elastic sealing element 60 and a cap 80. The plug housing 100 has a tubular lead-in region 102 for guiding the electrical lead 20 into the plug housing 100. A contact element 200 is attached to the electrical lead 20 and is fastened in the plug housing 100. The lead-in region 102 is aligned along a longitudinal axis X of the electrical lead 20 and has a constriction 104. The cap 80 is fastened on the plug housing 100 by retaining means. The cap 80 has an opening 82 for passing through the electrical lead 20. The sealing element 60 surrounds the electrical lead 20. The sealing element 60 is arranged between the constriction 104 and the cap 80.

Figure 2:
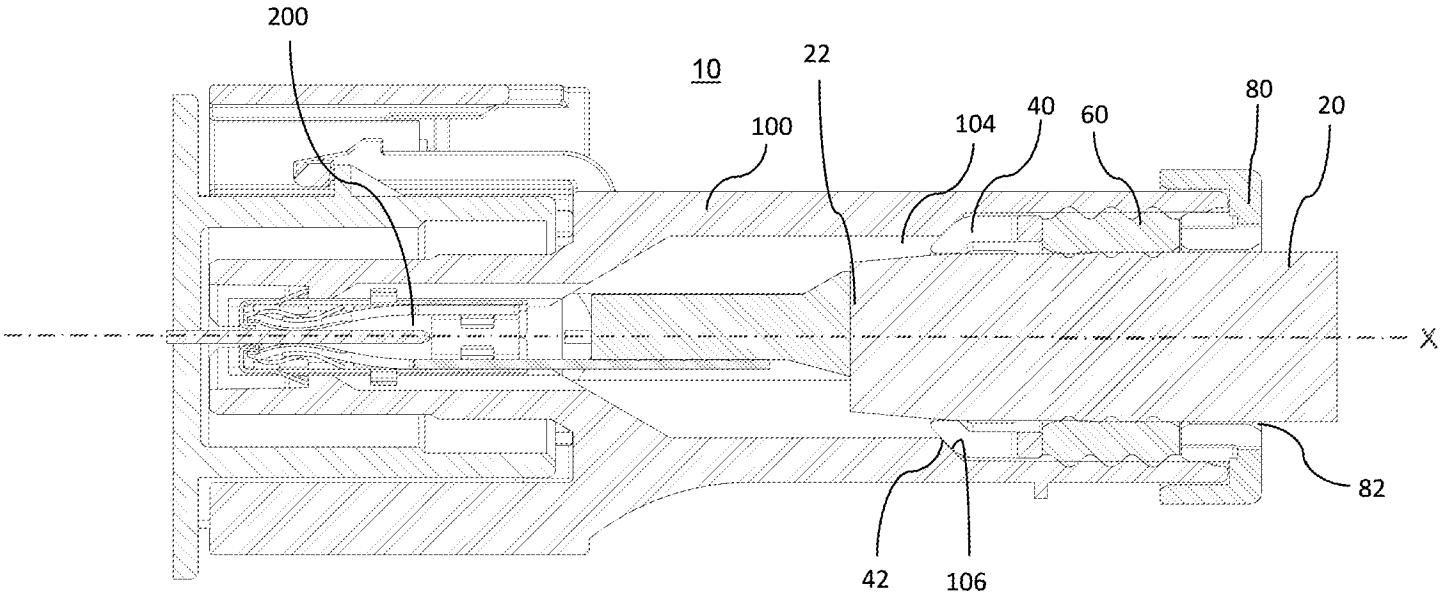
FIG. 2 shows cross-section view of an electrical connecting cable according to an embodiment of the invention.

FIG. 2 shows details of the electrical connecting cable of the invention in a cross-section view. An electrical connecting cable 10, comprising a plug housing 100, an electrical lead 20 with a lead end 22, a ring element 40, an elastic sealing element 60 and a cap 80. The plug housing 100 has a tubular lead-in region 102 for guiding the electrical lead 20 into the plug housing 100. The lead-in region 102 is aligned along a longitudinal axis X of the electrical lead 20 and has a constriction 104. The cap 80 is fastened on the plug housing 100 by retaining means. The cap 80 has an opening 82 for passing through the electrical lead 20. The ring element 40 encloses the electrical lead at least in part, and the sealing element 60 encloses the electrical lead. The ring element 40 and the sealing element 60 are arranged between the constriction 104 and the cap 80.

Figure 3:
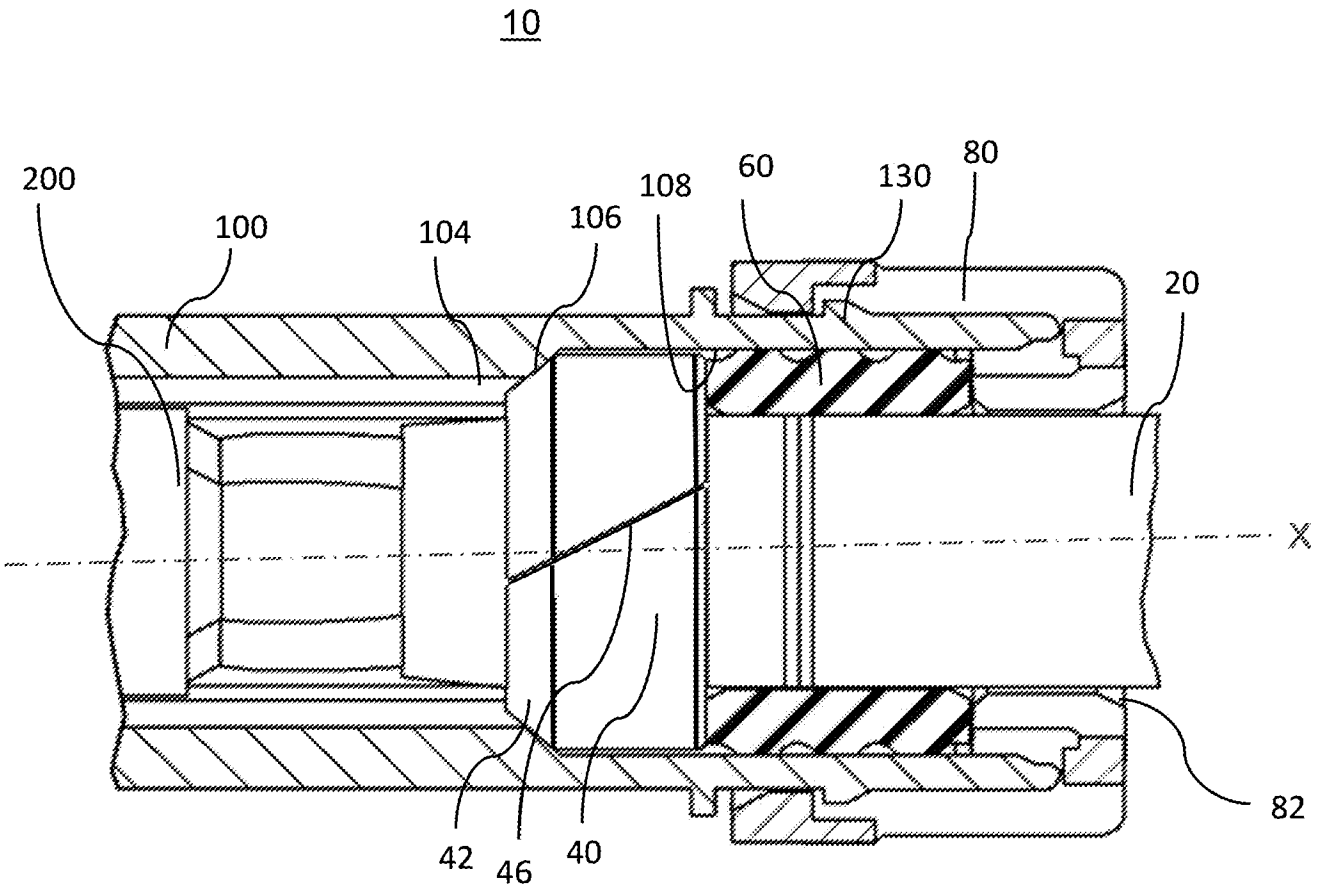
FIG. 3 is a detail view of the electrical connecting cable of FIG. 2 according to an embodiment of the invention.

FIG. 3 shows details of the cross-section view of FIG. 2. The constriction 104 has at least one first guide face 106 which is inclined in relation to the longitudinal axis X and is opposite the cap 80. The ring element 40 has a second guide face 42 which is inclined at a second guide angle 44 in relation to the longitudinal axis X and is opposite the first guide face 106. The first guide face 106 extends from an inner surface 108 of the tubular lead-in region 102, at a first guide angle 120 to the longitudinal axis X, into the tubular lead-in region 102 and then forms a funnel-shaped structure. The first guide angle 120 and the second guide angle 44 have the same value relative to the longitudinal axis X. The first guide angle 120 and the second guide angle 44 have a value of 45° in relation to the longitudinal axis X. The elastic sealing element 60 is elastically deformed between the cap 80 and the ring element 40. The ring element 40 and the second guide face 42 of the ring element 40 are pressed elastically against the first guide face 106 of the constriction 104 along the longitudinal axis X by the elastic sealing element 60. The ring element 40 has a reduced diameter whilst the second guide face 42 of the ring element 40 is pressed along the longitudinal axis X against the first guide face 106 of the constriction 104.

Figure 4:
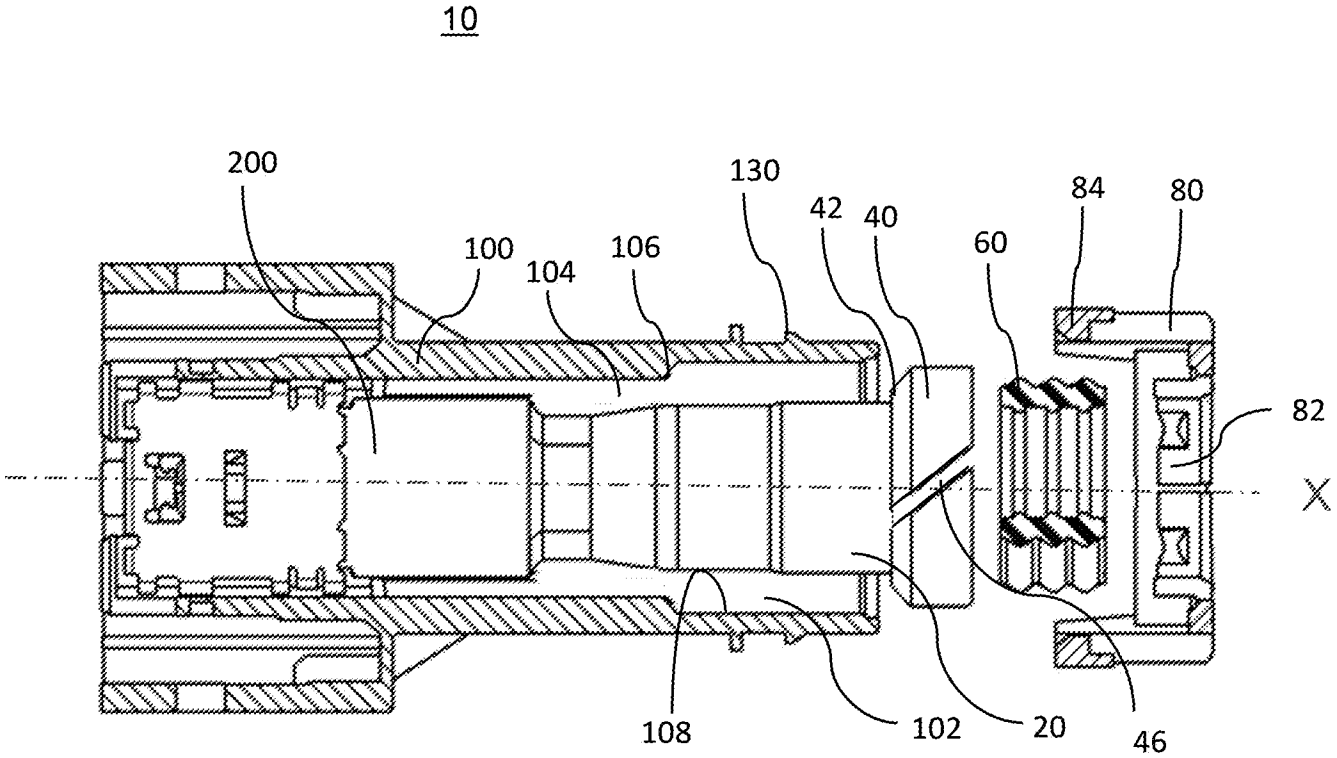
FIG. 4 shows a cross-section view of the electrical connecting cable is a partially mounted configuration according to an embodiment of the invention.

FIG. 4 shows a cross-section view of the electrical connecting cable of the invention, partially mounted. The retaining means for fastening the cap 80 on the plug housing 100 comprise detent hooks 84 which interact with protrusions 130 on the plug housing 100 in order to hold the cap on the plug housing 100.

Figure 5:
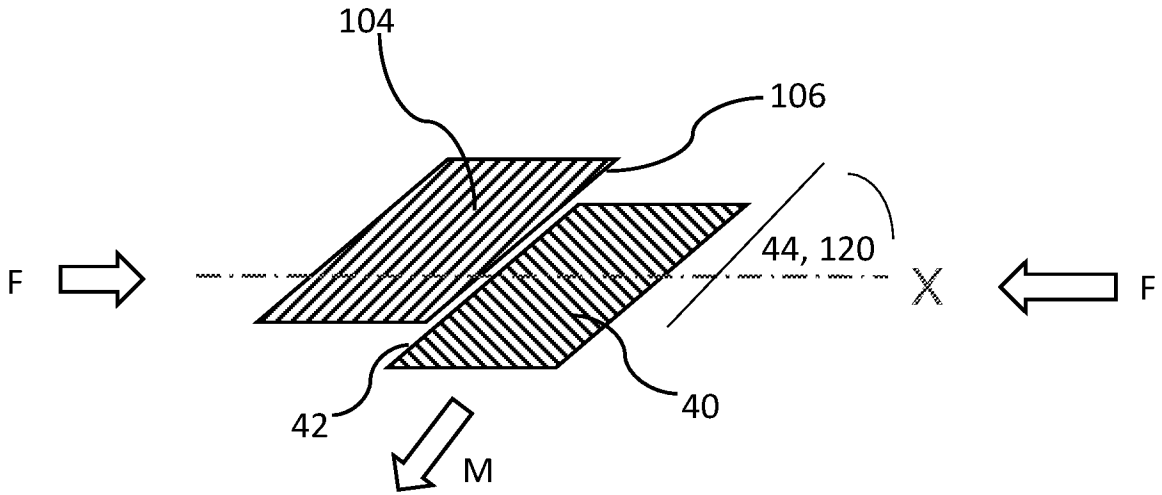
FIG. 5 is a schematic diagram of the force action and direction of movement of the ring element and the plug housing according to an embodiment of the invention.

FIG. 5 shows the force action and direction of movement of the ring element and the plug housing in a schematic diagram. The force F which presses the ring element 40 against the plug housing 100 along the longitudinal axis X has the result that the two parts move oppositely relative to one another. The ring element 40 slides along the first guide face 106 of the plug housing 100. So that this effect occurs, the first guide angle 120 and the second guide angle 44 must have an angle of less than 90° to the longitudinal axis X. A first guide angle of 45° and a second guide angle of 45° form a good compromise for the force applied and the resulting displacement path.

Figure 6:
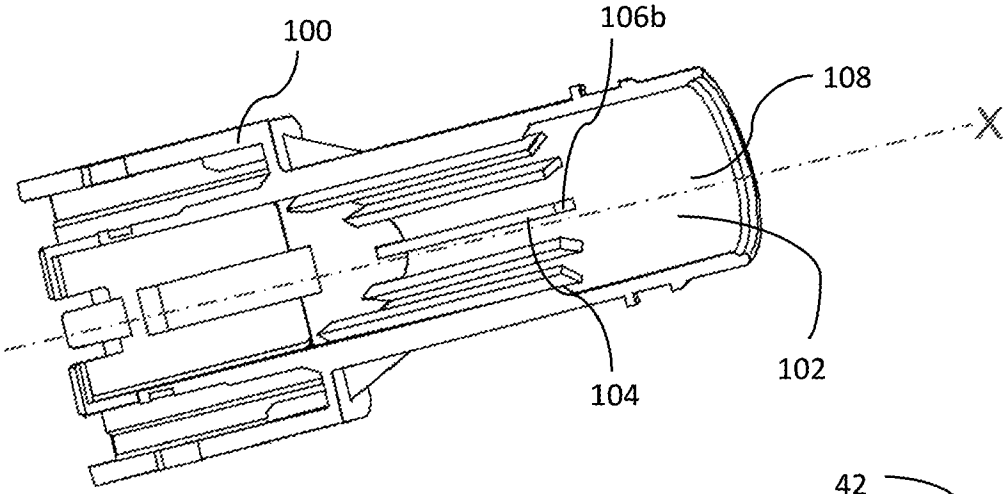
FIG. 6 is a cross-section view of a plug housing according to an embodiment of the invention.

FIG. 6 shows a cross-section view of a plug housing. The first guide face 106 is formed by a plurality of first part-faces 106*b*. The first part-faces 106*b* are arranged on ribs 110 which project into the tubular lead-in region 102.

Figure 7:
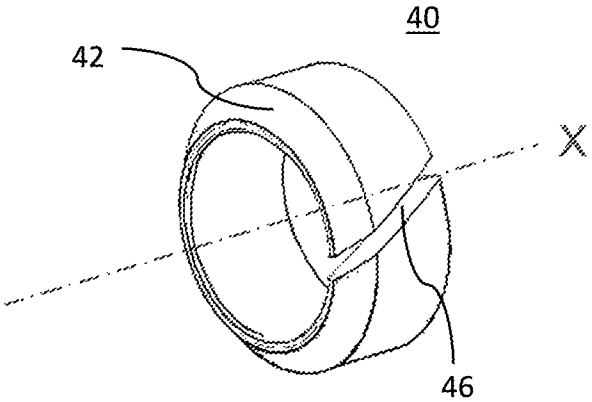
FIG. 7 is a perspective view of a ring element of the electrical connecting cable according to an embodiment of the invention.

FIG. 7 shows a perspective view of a ring element 40 of the electrical connecting cable 10 of the invention. The ring element 40 consists of a ring-shaped body which has a separating point 46. The separating point 46 runs diagonally to the axis of rotation of the ring element 40.

Figure 8:
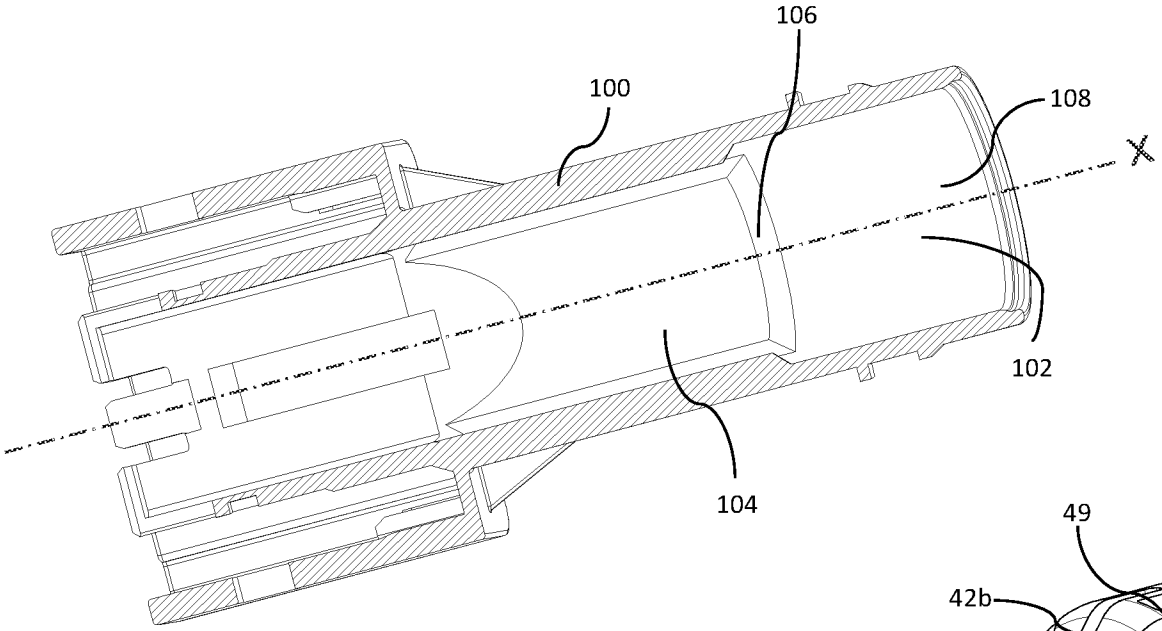
FIG. 8 is a cross-section view of an alternative plug housing according to an embodiment of the invention.

FIG. 8 shows a cross-section view of an alternative plug housing 100. The lead-in region 102 tapers along the first guide face 106 and extends as a constriction 104 along the longitudinal axis X.

Figure 9:
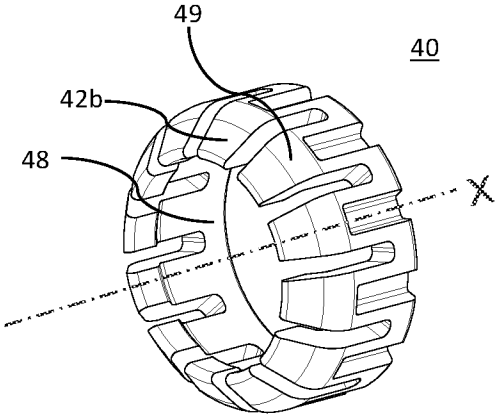
FIG. 9 is a perspective view of an alternative ring element of the electrical connecting cable according to an embodiment of the invention.

FIG. 9 shows a perspective view of an alternative ring element of the electrical connecting cable 10 of the invention. The ring element 40 has a base 48 from which a plurality of fingers 49 extend. The fingers 49 extend parallel to the longitudinal axis X from the base 48. The fingers 49 are arranged along the periphery of the ring element 40. The second guide face 42 is formed by a plurality of second part-faces 42*b* which are arranged at the finger ends.

Figure 10:
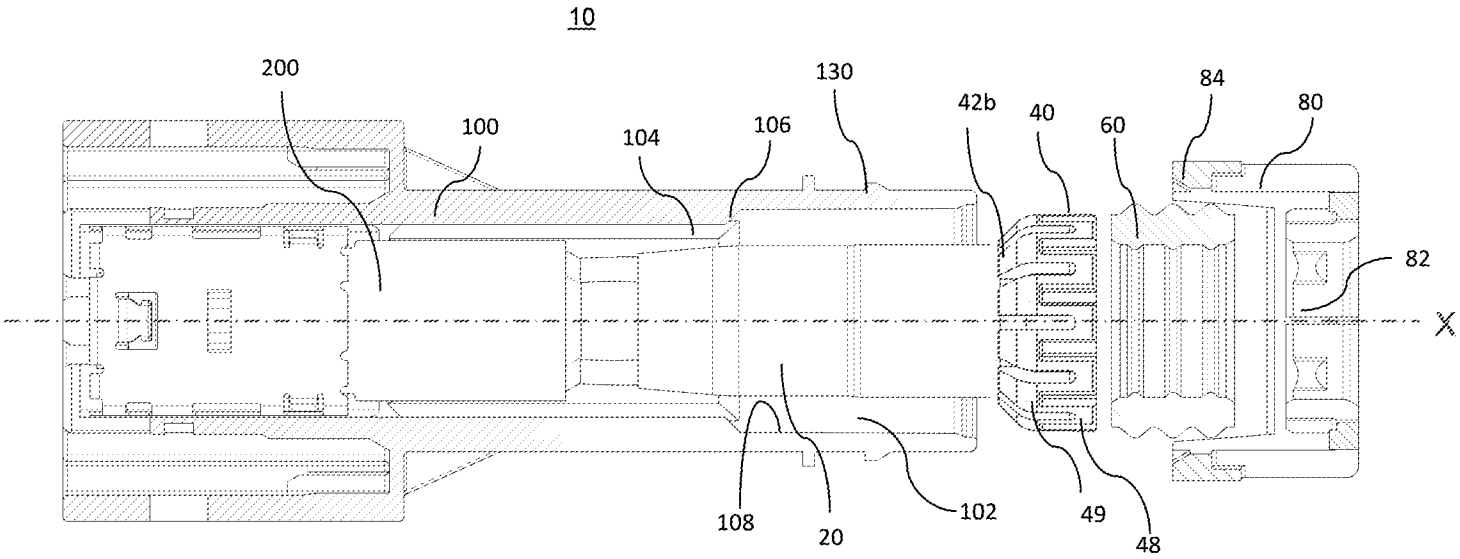
FIG. 10 is a cross-section view of an alternative embodiment of the electrical connecting cable in a partially mounted condition according to an embodiment of the invention.

FIG. 10 shows a cross-section view of an alternative embodiment of one of the electric cables of the invention, partially mounted. The base 48 of the ring element 40 is arranged on the side facing the sealing element 60. The second part-faces 42*b* are arranged opposite the first guide face 106.

Figure 11:
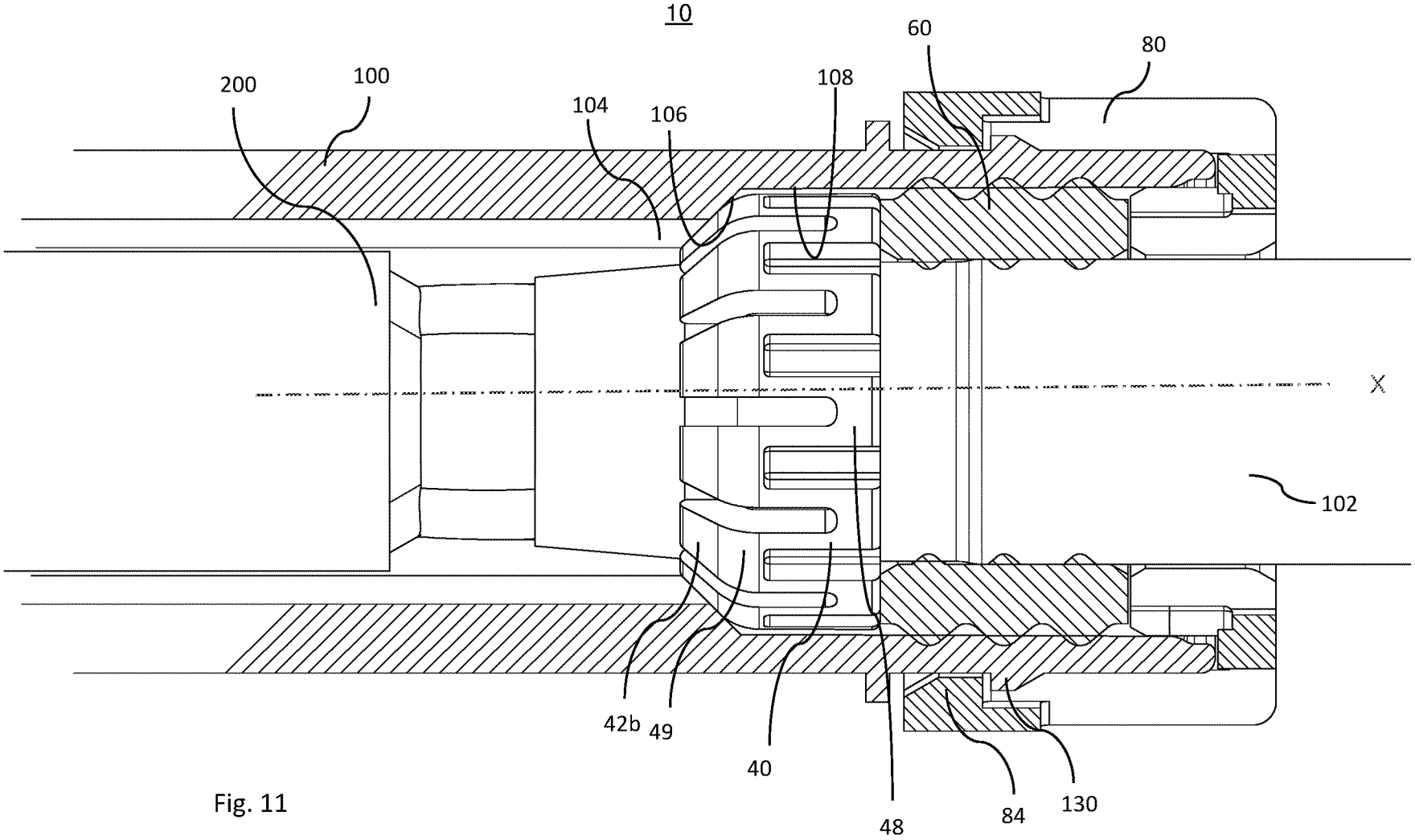
FIG. 11 is a detail view of the alternative embodiment shown in FIG. 10 in a mounted condition according to an embodiment of the invention.

FIG. 11 shows details of the alternative embodiment illustrated in FIG. 10, in the mounted state. The ring element 40 is located in its end position in the plug housing 100. The elastic sealing element 60 presses against the base 48 and thus also the entire ring element 40 in the direction of the constriction 104. The second part-faces 42*b* slide along the first guide face 106 whereby the fingers 49 are deformed in the direction of the electrical lead 20. The sealing element 60 is held in position by the cap 80, wherein the cap 80 is held in position through the interaction of a detent hook 84 on the cap 80 and a protrusion 130 on the plug housing 100.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any particular order, order of operations, direction or orientation unless stated otherwise.

I claim:

1. An electrical connecting cable, comprising:

a plug housing;

an electrical lead;

a ring element having a ring-shaped body defining a separating gap extending therethrough;

an elastic sealing element; and a cap, wherein the plug housing has a tubular lead-in region for guiding the electrical lead into the plug housing, wherein the lead-in region is aligned along a longitudinal axis of the electrical lead and has a plurality of constricting ribs, wherein the cap is fastened on the plug housing by retaining means, wherein the cap has an opening for passing through the electrical lead, wherein the ring element encloses the electrical lead at least in part, and the sealing element encloses the electrical lead, wherein the ring element and the sealing element are arranged between the plurality of constricting ribs and the cap, wherein each of the plurality of constricting ribs has a first guide face inclined in relation to the longitudinal axis and opposite the cap, wherein the ring element has a second guide face which is inclined at a second guide angle in relation to the longitudinal axis and is opposite the first guide face, wherein the ring element has a base from which a plurality of fingers extend, wherein the base adjoins the sealing element and wherein the plurality of fingers extend from the base parallel to the longitudinal axis spread out along a periphery of the ring element, and wherein the second guide face is formed by a plurality of second part-faces which are arranged at ends of the plurality of fingers.

2. The electrical connecting cable according to claim 1, wherein the second guide face of the ring element is pressed elastically against the first guide face of the plurality of constricting ribs along the longitudinal axis by the elastic sealing element.

3. The electrical connecting cable according to claim 1, wherein the ring element has a reduced diameter when the second guide face of the ring element is pressed along the longitudinal axis against the first guide face of the plurality of constricting ribs due to a narrowing of the separating gap.

4. The electrical connecting cable according to claim 1, wherein the first guide face extends from an inner surface of the tubular lead-in region, at a first guide angle to the longitudinal axis, into the tubular lead-in region and then forms a funnel-shaped structure.

5. The electrical connecting cable according to claim 4, wherein the first guide angle and the second guide angle have a value of 45° in relation to the longitudinal axis.

6. The electrical connecting cable according to claim 4, wherein the first guide angle and the second guide angle have the same value in relation to the longitudinal axis.

7. The electrical connecting cable according to claim 1, wherein the separating gap runs diagonally to an axis of rotation of the ring-shaped body.

8. The electrical connecting cable according to claim 1, wherein the elastic sealing element is deformed elastically between the cap and the ring element.

9. The electrical connecting cable according to claim 1, wherein the retaining means for fastening the cap on the plug housing comprise detent hooks which interact with protrusions on the plug housing in order to hold the cap on the plug housing.

10. The electrical connecting cable according to claim 1, wherein the plurality of constricting ribs extends from an inner surface of the tubular lead-in region and parallel to the longitudinal axis.

11. A method for manufacturing an electrical connecting cable, comprising the steps of:

providing a plug housing, an electrical lead, a ring element having a ring-shaped body defining a separating gap extending therethrough, an elastic sealing element, a cap, and a contact element, wherein the cap is fastened on the plug housing by retaining means, wherein the ring element has a base from which a plurality of fingers extend, wherein the base adjoins the sealing element, wherein the plurality of fingers extend from the base parallel to a longitudinal axis spread out along a periphery of the ring element, wherein a guide face is formed by a plurality of second part-faces which are arranged at ends of the plurality of fingers, and wherein the plug housing has a tubular lead-in region defining a plurality of constricting ribs for guiding the electrical lead into the plug housing;

sliding a lead end of the electrical lead through an opening of the cap;

sliding the elastic sealing element onto the lead end of the electrical lead;

sliding the ring element onto the lead end of the electrical lead;

sliding the lead end through the tubular lead-in region through the plug housing;

attaching and electrically connecting the contact element to the lead end of the electrical lead;

drawing back the electrical lead so that the contact element is moved into the plug housing and latches therein; and sliding the cap in the direction of the plug housing until the retaining means fixes the cap on the plug housing, wherein the ring element is pressed against the plurality of constricting ribs in the plug housing and thereby fixes the electrical lead in the plug housing.

12. The method according to claim 11, wherein the step of sliding the cap in the direction of the plug housing until the retaining means fixes the cap on the plug housing causes a narrowing of the separating gap in the ring element, thereby reducing the diameter of the ring element.

13. The method according to claim 11, wherein the plurality of constricting ribs extends from an inner surface of the tubular lead-in region and parallel to the longitudinal axis.

* * * * *